US005599645A

United States Patent [19]

Tamiya et al.

[11] Patent Number: 5,599,645

[45] Date of Patent: Feb. 4, 1997

[54] IMAGE TRANSFER METHOD FOR AN IMAGE FORMING APPARATUS

[75] Inventors: Takahiro Tamiya, Tokyo; Nobuo Iwata, Sagamihara; Tsuyoshi Deki, Koshigaya; Takeshi Motohashi, Kawasaki, all of Japan

[73] Assignee: Ricoh Company, Ltd., Tokyo, Japan

[21] Appl. No.: 439,139

[22] Filed: May 11, 1995

[30] Foreign Application Priority Data

May 12, 1994 [JP] Japan ..... 6-098746
Apr. 10, 1995 [JP] Japan ..... 7-083824

[51] Int. Cl.[6] ..... G03G 13/16

[52] U.S. Cl. ..... 430/126; 399/314

[58] Field of Search ..... 430/126, 124; 355/274

[56] References Cited

U.S. PATENT DOCUMENTS 4,014,605 3/1977 Fletcher ..... 355/3 R
5,266,437 11/1993 Yamane et al. ..... 430/126
5,418,105 5/1995 Wayman et al. ..... 430/126

FOREIGN PATENT DOCUMENTS 4-115266 4/1992 Japan .

*Primary Examiner*—John Goodrow
*Attorney, Agent, or Firm*—Oblon, Spivak, McClelland, Maier & Neustadt, P.C.

[57] ABSTRACT

In an image forming apparatus of the type sequentially forming powder images of different colors on an image carrier, and sequentially transferring them to an acceptor one above the other (primary transfer), an image transfer method is disclosed which prevents transfer dust from being transferred to the acceptor at the time of the primary transfer. During the primary transfer, a bias potential $V_1$ is applied to one of two conductors located at an upstream side. The potential $V_1$ has the same polarity as the charged powder carried on the image carrier. A potential $V_2$ is applied to the other conductor at a downstream side and provided with a polarity opposite to the polarity of the charged powder. Every time the primary transfer is repeated, the potentials $V_l$ and $V_2$ are respectively sequentially shifted toward the polarity of the powder and toward the polarity opposite to the polarity of the powder.

9 Claims, 14 Drawing Sheets

IMAGE TRANSFER METHOD FOR AN IMAGE FORMING APPARATUS

BACKGROUND OF THE INVENTION

The present invention relates to an image transfer method for an image forming apparatus.

Among full-color image forming apparatuses, an electrophotographic printer using an intermediate image transfer body has an inherently high output speed and color reproducibility and is operable without regard to the kind of paper. This type of printer has a photoconductive element or similar image carrier made of a semiconductor or an insulator. An intermediate transfer belt or similar acceptor adjoins or contacts the image carrier in a preselected nip portion and moves in the same direction as the image carrier. The acceptor is implemented as a single semiconductor layer or provided with a double layer structure having a semiconductor layer and an insulator on the inner and outer peripheries thereof, respectively. Two conductors for applying transfer biases are respectively spaced apart from the middle point of the nip portion by distances L1 and L2 and located upstream and downstream with respect to the direction of movement of the acceptor. Toner or similar charged powder is conveyed by the image carrier to the nip portion between the two conductors. The charged powder is transferred from the image carrier to the acceptor a plurality of times to complete a full-color image. Specifically, latent images sequentially formed on the image carrier, or donor, are each developed by one of yellow, magenta, cyan and black toner to turn out a toner image. The toner images are sequentially transferred from the donor to the acceptor (primary transfer or intermediate transfer) one above the other, and then transferred from the acceptor to a paper at a time (secondary transfer).

However, the problem with the apparatus of the type described is that the image has its contour and colors blurred by so-called image dust. The image dust is particularly conspicuous when the primary transfer is repeated a plurality of times, and in this sense it is generally referred to as transfer dust. While various approaches to eliminate the transfer dust have been proposed in the past, none of them is satisfactory. Particularly, when the potential of the toner transferred to the acceptor remains at the time of the next primary transfer, the transfer dust is aggravated.

SUMMARY OF THE INVENTION

It is, therefore, an object of the present invention to provide an image transfer method for an image forming apparatus and capable of obviating the transfer dust in the event of primary or intermediate transfer.

In an image forming apparatus having an image carrier made of a semiconductor or an insulator, an acceptor made of a semiconductor or an insulator, and adjoining or contacting one surface of the image carrier at a predetermined nip portion for image transfer, and movable in the same direction as the image carrier, and two conductors for applying biases for image transfer, and contacting the other surface of the image carrier, and respectively spaced apart from the middle point of the nip portion by distances L1 and L2 at an upstream side and a downstream side with respect to the above direction, a method of transferring charged powder being conveyed by the image carrier to the acceptor a plurality of times in a stack has the steps of applying to one of the two conductors located at the upstream side a potential $V_1$ of the same polarity as the charged powder carried on the image carrier, applying to the other conductor located at the downstream side a potential $V_2$ opposite in polarity to the charged powder carried on the image carrier, and sequentially shifting the potential $V_1$ toward the polarity of the powder and the potential $V_2$ toward the polarity opposite to the polarity of the powder every time an image transfer is repeated.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
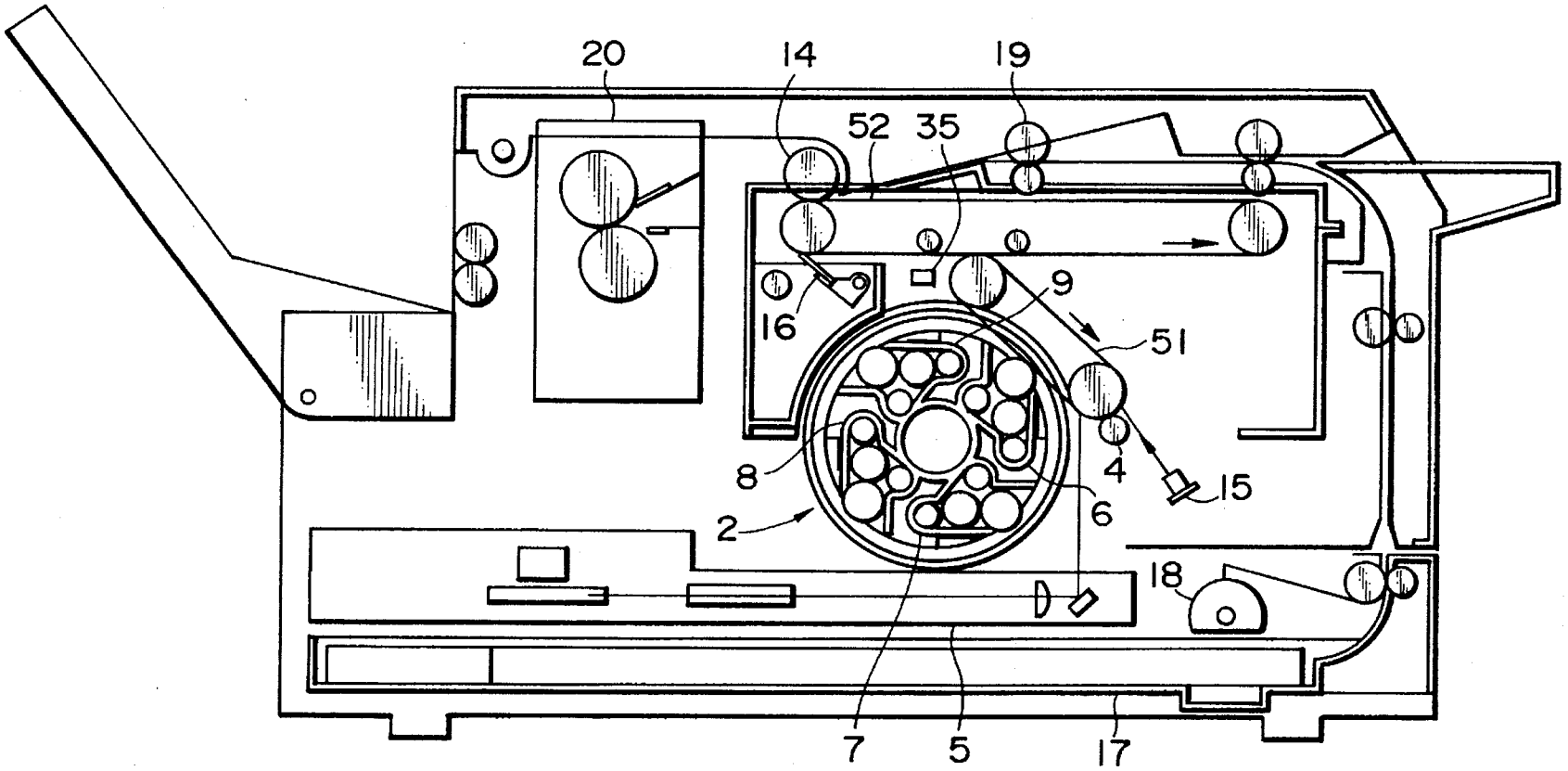
FIG. 1 is a section showing the general construction of an image forming apparatus to which the present invention is applicable.

To better understand the present invention, a brief reference will be made to a conventional color image forming apparatus using an intermediate image transfer body, shown in FIG. 1. It is to be noted that an image transfer method of the present invention is applicable to the apparatus to be described. As shown, the apparatus has an image carrier in the form of a belt 51 and rotatable in a direction indicated by an arrow in the figure. A charge roller 4 charges the surface of the belt 51 to a predetermined potential $V_D$. The image carrier is implemented by a semiconductor or an insulator and usually referred to as a photoconductor. Laser optics 5 electrostatically forms a latent image, or potential distribution, on the charged surface of the belt 51. The latent image is an image pattern corresponding to one of four colors, i.e., yellow, magenta, cyan and black separated from a desired full-color image. A rotary developing device, or revolver as generally referred to, 2 has developing units 6, 7, 8 and 9 storing yellow, magenta, cyan and black developers, respectively. The latent image is developed by one of the developing units 6–9 by contact or non-contact development, thereby turning out a toner image.

An acceptor 52 is rotated counterclockwise in contact with the image carrier, or donor, 51. The toner image is transferred from the donor 51 to the acceptor 52. This will be referred to as primary transfer or intermediate transfer hereinafter. This procedure is repeated in the order of yellow, magenta, cyan and black with the result that yellow, magenta, cyan and black toner images are sequentially stacked on the acceptor 52 in accurate register. The acceptor 52 is a so-called intermediate transfer belt. While the acceptor 52 will be described as having a single layer, it may consist of an inner semiconductor layer and an outer insulator layer. A paper is fed from a cassette 17 by a pick-up roller 18 and a registration roller pair 19. The composite color image is transferred from the intermediate transfer belt 52 to the paper. This will be referred to as secondary transfer. The position assigned to the secondary transfer will be referred to as a secondary transfer position. Specifically, a paper transfer roller 14 transfers the composite color image from the belt 52 to the paper. Thereafter, the paper has the image fixed thereon by a fixing unit 20 and then driven out of the apparatus as a full-color copy.

After the primary transfer, the toner of each color left on the donor 51 is removed by a donor cleaning unit 15. Further, the potentials remaining on the donor 1 are removed by a discharger 35. On the other hand, after the secondary transfer, the toner remaining on the acceptor 52 is removed by an acceptor cleaning blade 16. The blade 16 is brought into contact with the acceptor 52 only after the transfer of the composite toner image to the paper.

Figure 2A:
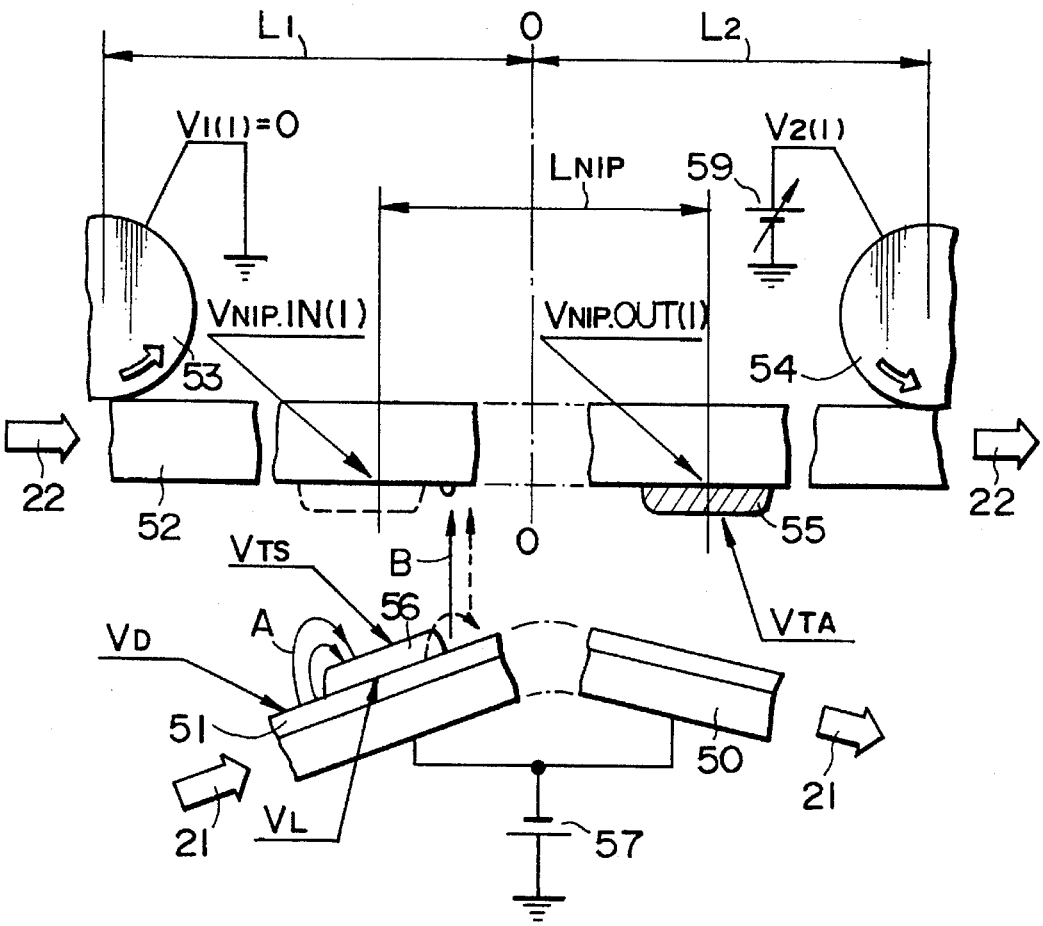
FIG. 2A PRIOR ART
FIGS. 2A, 2B, 3A, 3B, 4A, 4B, 5A and 5B show a conventional image transfer method.
Figure 2B:
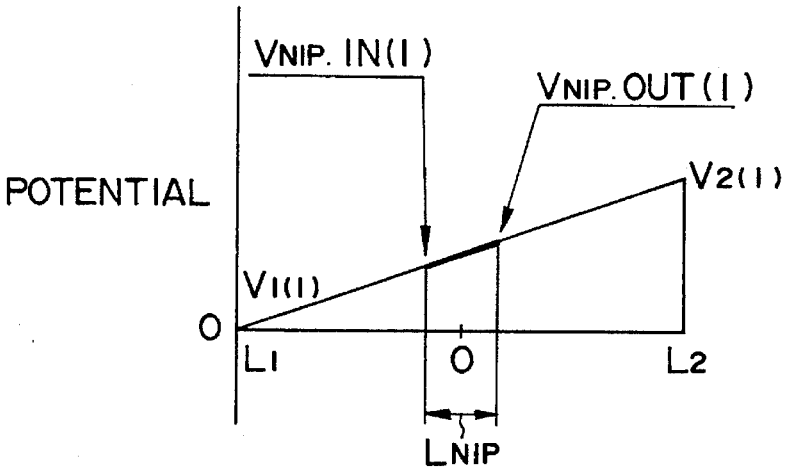
FIG. 2B PRIOR ART

As also shown in FIGS. 2A and 2B, the donor 51 is passed over two rollers. The acceptor 52 is also passed over two rollers and held in contact with the intermediate portion of the donor 51. The contact portion and portions adjoining it will be collectively referred to as a nip portion. Even when the donor 51 and acceptor 52 simply adjoin each other without physical contact, the adjoining portion will also be referred to as a nip portion.

In this type of apparatus, the contour and color of an image are blurred by so-called image dust or transfer dust, as discussed earlier. Why the image dust is produced will be discussed hereinafter.

1st Primary Transfer

FIG. 2A illustrates the first primary transfer. As shown, the donor 51 and acceptor 52 are moved in directions indicated by arrows 21 and 22, respectively. Hence, they are moved in the same direction, as seen at the nip portion. The position where the donor 51 and acceptor 52 contact each other is not shown for the sake of simplicity. Assume a line O—O passing though the middle point of the nip portion. Conductors 53 and 54 are implemented as rollers and respectively located at positions spaced apart from the line O—O by distances $L_1$ and $L_2$. The conductors 53 and 54 are rotatable in contact with the rear of the acceptor 52. The conductor 53, located upstream in the direction of movement of the acceptor 52, will be called an inlet conductor because it is positioned at the inlet of the nip portion. In the same sense, the downstream conductor 54 will be called an outlet conductor.

In FIG. 2A, assume that the portions of the donor 51 and acceptor 52 facing each other at a distance smaller than the gaseous discharge distance have a length, or nip length, $L_{NIP}$. Then, the center of the nip length $L_{NIP}$ is coincident with the line O—O. In practice, the donor 51 and acceptor 52 contact each other on the line O—O in the manner shown in FIG. 1. However, FIG. 2A and other figures corresponding thereto do not show the contact portion and show the donor 51 and acceptor 52 as if they were spaced apart from each other.

A toner image, or charged powder layer, 56 is formed on the donor 51 by the revolver 2 by the previously stated procedure. Assume that a negative charge has been deposited on the layer 56 which is to be transferred to the acceptor 52. A charged powder layer 55 has been transferred to the acceptor 52 by the first primary transfer. It should be noted that numerals in parenthesized suffixes to appear hereinafter each indicates the number of times of primary transfer. To facilitate the primary transfer, the inlet conductor 53 is connected to ground while the outlet conductor 54 is applied with the positive polarity of a variable voltage source 59. The donor 51 has a conductive base 50. A power source 57 for setting a base potential is connected to the base 50.

Assuming that a potential $V_{1(1)}$ is applied to the upstream conductor 53, then the voltage $V_{1(1)}$ is zero. Further, assuming that a potential $V_{2(1)}$ is applied to the downstream conductor 54 from the power source 59, then the potential distribution of the acceptor 52 is controlled as shown in FIG. 2B. As shown, a potential $V_{NIP.OUT(1)}$ at the outlet of the nip length $L_{NIP}$, has a greater gradient than a potential $V_{NIP.IN(1)}$ at the inlet. Both of the potentials $V_{NIP.IN(1)}$ and $V_{NIP.OUT(1)}$ have a positive polarity opposite to the polarity of the layer 56. Specifically, as shown in FIG. 2B, when potentials $V_1$ and $V_2$ hold, a potential gradient occurs between the inlet and the outlet of the nip portion, where the conductors 53 and 54 contact the acceptor 52, because the acceptor 52 is not conductive. As a result, a potential gradient also occurs between the opposite ends of the nip length $L_{NIP}$ due to proportional allotment.

In FIG. 2A, assume that the donor 51 has a potential $V_D$ (=−900 V) in a non-image portion and a potential $V_L$ (=−200 V) in an image portion or illuminated portion, and that the layer 56 on the donor 51 has a surface potential $V_{TS}$. Then, an electric line of force A (indicated as extending from negative to positive) acts in a direction for retaining the powder on the layer 56. However, at the moment when the donor 51 enters the nip portion, the direction of the electric line of force A, acting between the donor 51 and the layer 56, is sharply reversed, as indicated by an arrow B; the line A is directed from the donor 51 toward the acceptor 52. As a result, the force retaining the layer 56 on the donor 51 is lost at the edges of the layer 56. Hence, the powder moves in a direction indicated by a phantom arrow, deforming the layer 56 in the lateral direction. In this manner, the layer 56 begins to deform before the transfer to the acceptor 52, and the separated powder deposits on the acceptor 52 outside of the expected toner image indicated by a phantom line. This part of the powder is the so-called transfer dust. The transfer dust is of a single color and occurs before the actual image transfer. In FIG. 2A, labeled $V_{TA}$ is the surface potential of the layer 55 on the acceptor 52.

2nd Primary Transfer

Figure 3A:
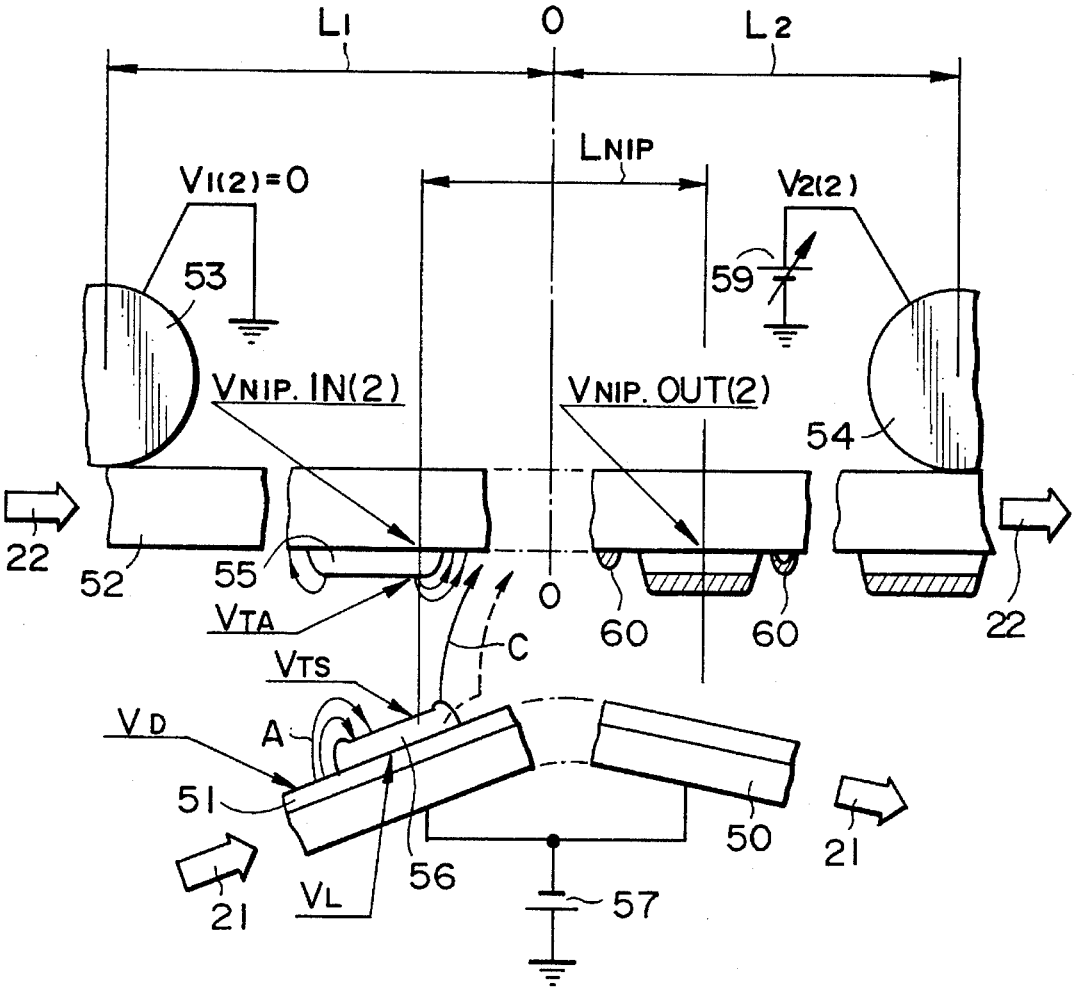
FIG. 3A PRIOR ART
Figure 3B:
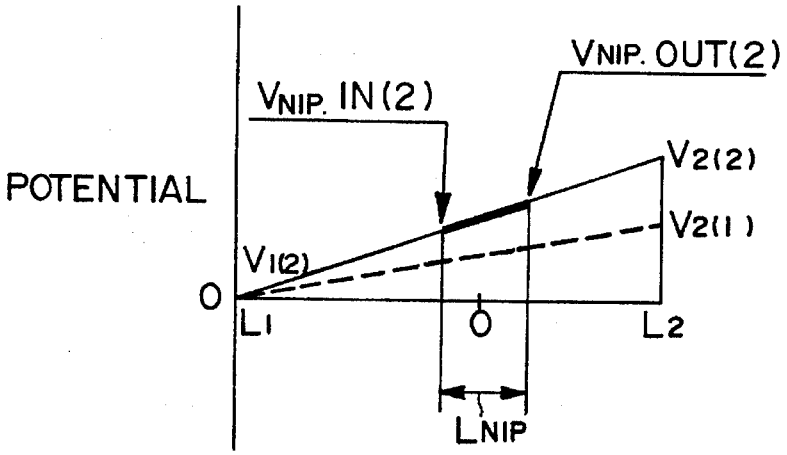
FIG. 3B PRIOR ART

As shown in FIG. 3A, a potential $V_{2(2)}$ applied to the conductor 54 is stepped up to the positive side. The potential $V_{2(2)}$ is superposed on the potential deposited by the first primary transfer. This increases a potential $V_{NIP.IN(2)}$ accordingly, as shown in FIG. 3B. As a result, an electric line of force C appears due to the surface potential $V_{TS}$ of the layer 56, the potential $V_{NIP.IN(2)}$ of the acceptor 52 shifted to the positive side, and the surface potential $V_{TA}$ of the layer 55 on the acceptor 52. The electric line of force C causes the powder to move in a bent direction. Consequently, transfer dust 60 is also deposited on the acceptor 52 in the second primary transfer.

3rd Primary Transfer

Figure 4A:
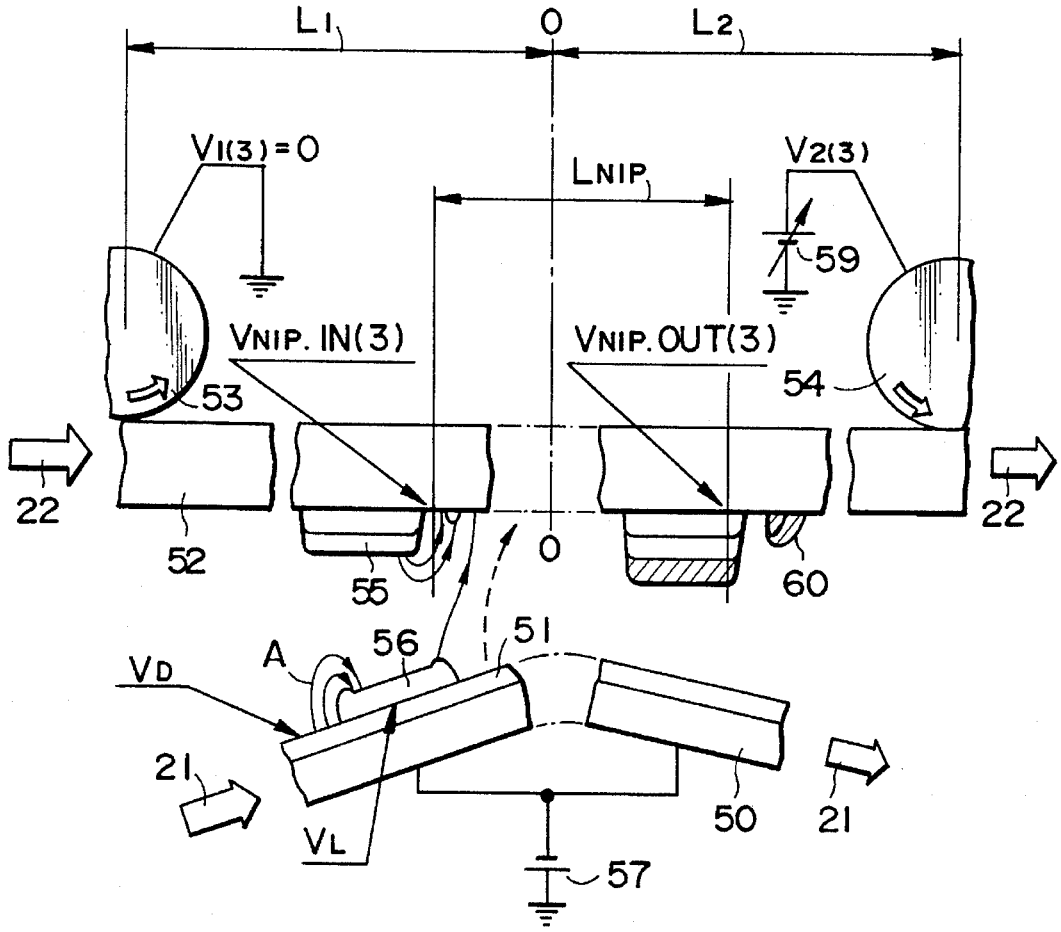
FIG. 4A PRIOR ART
Figure 4B:
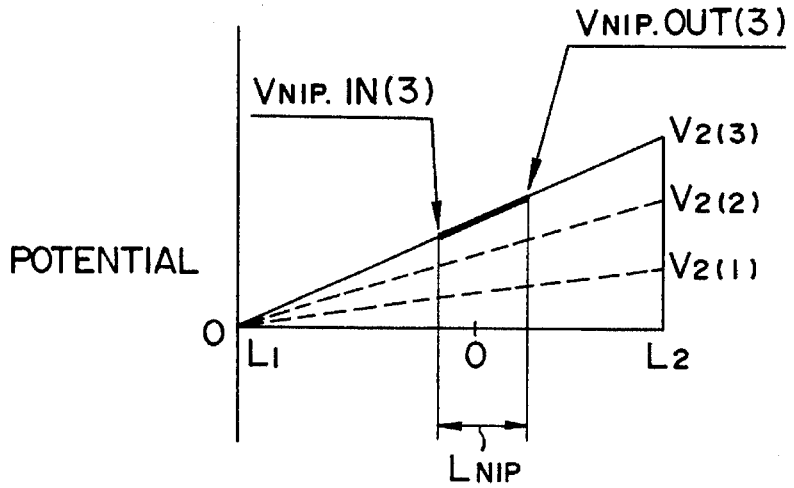
FIG. 4B PRIOR ART

As shown in FIG. 4A, a potential $V_{2(3)}$ applied to the conductor 54 is further stepped up to the positive side. The potential $V_{2(3)}$ is superposed on the potential deposited during the second primary transfer. This increases a potential $V_{NIP.IN(3)}$ accordingly, as shown in FIG. 4B. On the other hand, the thickness of the powder layer on the acceptor 52 has increased due to the repeated primary transfer. Hence, the surface potential $V_{TA}$ of the layer on the acceptor 52 has increased to the negative side, and the difference between the surface potential and the potential of the background of the acceptor 52 has increased.

4th Primary Transfer

Figure 5A:
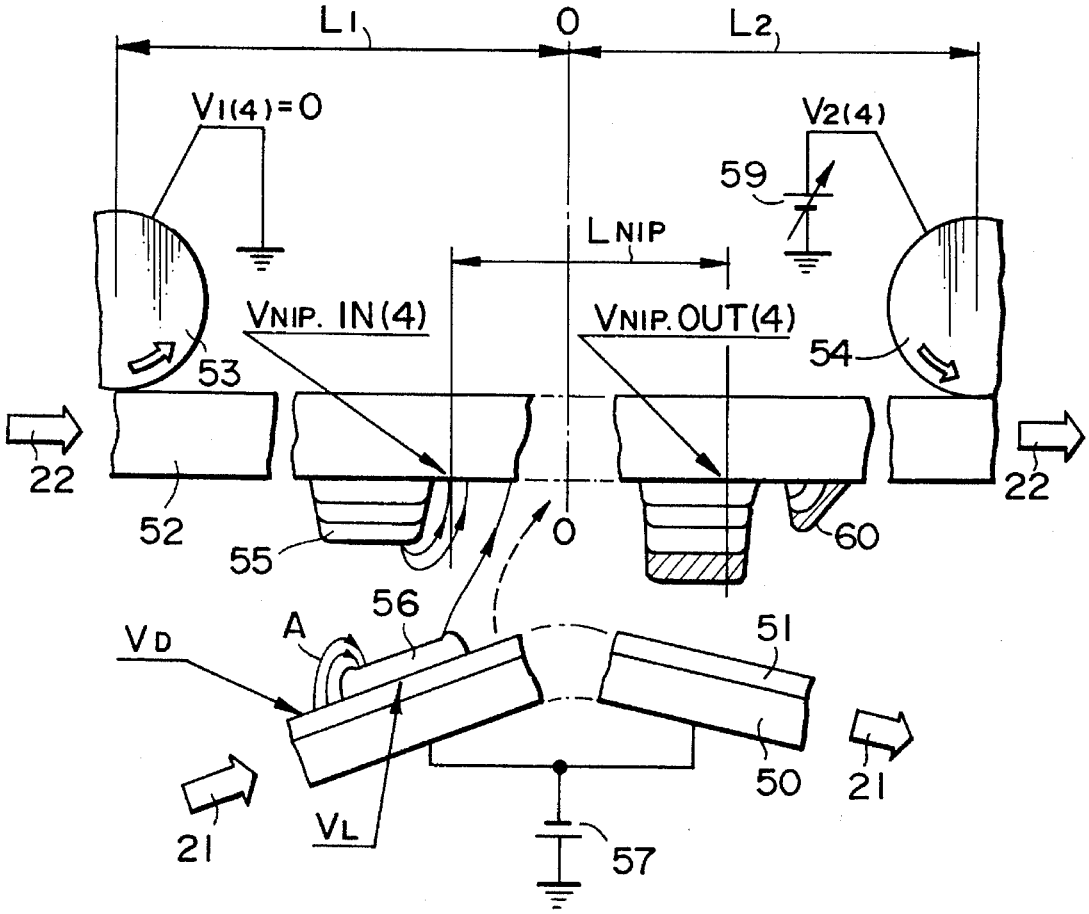
FIG. 5A PRIOR ART
Figure 5B:
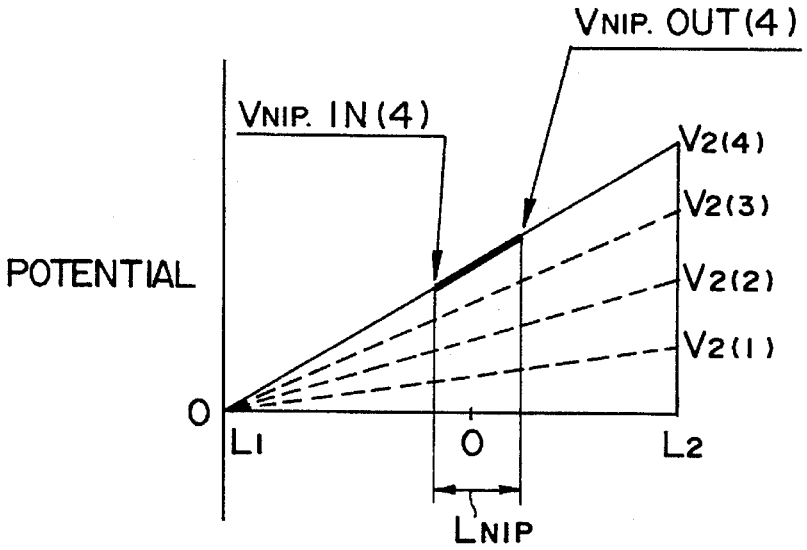
FIG. 5B PRIOR ART

As shown in FIG. 5A, a potential $V_{2(4)}$ applied to the conductor 54 is further stepped up to the positive side. The potential $V_{2(4)}$ is superposed on the potential deposited during the third primary transfer. This increases a potential $V_{NIP.IN(4)}$ accordingly, as shown in FIG. 5B. On the other hand, the thickness of the powder layer on the acceptor 52 has increased. Hence, the surface potential $V_{TA}$ of the layer on the acceptor 52 and, therefore, the difference between it and the background potential of the acceptor 52 has further increased. In this condition, the powder to be transferred from the contour portion of the layer 56 is directed toward the background of the acceptor 52 away from the powder layer 55, as indicated by a phantom arrow. This part of the powder is the transfer dust 60. It follows that the transfer dust is heaviest at the last primary transfer, i.e., last color.

To obviate the transfer dust described above, it has been customary with an image forming apparatus of the type using a charger, or non-contact discharging unit, to use a shield plate. The shield plate intercepts the flow of discharge gas into the inlet of the nip portion, so that a transfer electric field can be applied after the donor and acceptor have sufficiently contacted each other. Specifically, a transfer potential is not applied when toner deposited on the donor is remote from toner existing on the acceptor. The electric field is applied after the former has been brought close to the latter. This prevents the toner forming the contour of an image from being displaced to turn out transfer dust. On the other hand, there is under development a system which directly applies a bias to the intermediate transfer body so as to provide an electric field region only in the vicinity of the primary transfer position. The shield plate scheme and the direct bias scheme are respectively referred to as a far electric field forming system and a contact electric field forming system for distinction. Particularly, the direct bias scheme is in study actively in order to eliminate the problems of a non-contact charger, e.g., great current consumption and ozone.

Documents relating to the direct bias scheme are as follows.

(a) Japanese Patent Laid-Open Publication No. 2-183276: As to the primary transfer, a bias higher than the bias applied for the immediately preceding color is applied for the last color. In addition, a bias is continuously applied even during the interval between the successive primary transfers. The same bias is applied at the inlet and outlet for the primary transfer. The particular bias for the last color is adapted to obviate a defective image due to the superposed toner. The bias during the interval is adapted to obviate the return of the transferred toner and is required because the intermediate transfer belt is longer than the photoconductive element.

(b) Japanese Patent Laid-Open Publication No. 2-212870: A unique method of arranging a conductive roller and layout are disclosed together with the application of a bias opposite in polarity to toner. The same bias is applied at the inlet and outlet for the primary transfer. The roller arrangement and layout constitute a measure against the local omission of an image due to the irregular nip pressure which is attributable to mechanical vibration.

(c) Japanese Patent Laid-Open Publication No. 3-282491: A plurality of conductive rollers are held in contact with the rear of the belt at a position upstream of the secondary transfer position. The rollers are selectively connected to ground in accordance with the belt speed. The potential gradient is changed in order to obviate the transfer dust at the secondary transfer position. This prior art is not relevant to the repeated primary transfer.

(d) Japanese Patent Laid-Open Publication No. 4-310979: When the bias for the primary transfer is variable, optics for writing an image is controlled. Specifically, a change in the transfer ability due to a change in the transfer voltage and the irregular toner deposition is corrected. A specific step-up method is also taught in this document. However, this prior art also pertains to the secondary transfer.

(e) Japanese Patent Laid-Open Publication No. 4-318578: The intermediate transfer belt is provided with a volume resistivity of $10^8$ Ωcm to $10^{12}$ Ωcm, and the bias for the primary transfer is stepped up color by color. In addition, a greater electric field is assigned to the secondary transfer than to the primary transfer. The particular volume resistivity and color-by-color step-up constitute a measure against disturbance to an image, while the particular electric field is adapted to improve the transfer ratio. This prior art is based on a single conductor.

(f) Japanese Patent Laid-Open Publication No. 2-110586 and U.S. Pat. No. 5,172,173: The transfer belt is configured to transfer an image only once and provided with a particular laminate structure and particular volume resistivity. A potential gradient has a peak at the downstream side. This prior art contemplates to improve the image quality and is not directly related to the color-by-color bias change.

(g) Japanese Patent Laid-Open Publication No. 2-50170: This prior art has the following features (i)–(iv):

(i) Use is made of a belt having an intermediate resistance, i.e., $10^7$ Ωcm to $10^{10}$ Ωcm in order to avoid charge-up particular to a belt having a high resistance. The above range of resistance is not so low as to cause dielectric breakdown and is not so high as to cause breakdown or discharge because it suitably scatters the charge from local charge-up.

(ii) To avoid backward or reverse transfer, a sure electric field for transfer is applied. For this purpose, the electric field is stepped up from a direction for causing the toner transfer to occur to a direction for further promoting the toner transfer. The charge of the toner previously transferred to an intermediate transfer body has influence on the toner to be transferred. This is why the electric field is stepped up in the event of the superposition of colors. In the document, a negative bias is applied to positively charged toner in order to pull it.

(iii) Use is made of toner of low resistance and scarcely exhibiting an edge effect. This is to eliminate defective transfer at the boundary and defective color reproduction due to transfer dust. Toner of high resistance would deposit in a great amount at the boundary due to the edge effect, resulting in an excess electric field. This would cause the gradient of the transfer electric field to deviate, or rotate, at the boundary and thereby scatter the toner being transferred in the vicinity of the boundary.

In the above feature (ii), the electric line of force extends in a direction for transferring the toner by a bias which is basically opposite in polarity to the toner. The bias is stepped up to increase the transfer ratio. The feature (iii) is adapted to obviate the transfer dust due to color stacking. A particular bias is applied at each of the input and outlet. Although this prior art refers to a potential difference, it does not show or describe a step-up in a direction for preventing the toner from being transferred. The prior art causes reverse transfer to relation to the feature (ii).

(iv) Regarding the reverse transfer, the present invention is theoretically opposite to this document because it apparently causes the reverse transfer to increase. Moreover, the document copes with the transfer dust only by using toner of low resistance.

As stated above, the implementation of this document is not satisfactory when it comes to the transfer dust caused by toner. Because this document determines a voltage at the nip portion on the basis of a resistance ratio, it needs a current and, therefore, surely effects the discharge from an electrode to the rear of the belt. This idea belongs to a volume resistivity domain and differs from the resistance division of the present invention. In the document, an outlet roller at the primary transfer section is held in a floating state. The description of this document is not consistant unless the belt is implemented as a single layer. The document further describes the amount of charge for a unit volume q/m, toner of low resistance, etc.

(h) Japanese Patent Laid-Open Publication No. 4-29174: A belt for a monochromatic machine is disclosed which is different from an intermediate transfer body for a color image forming apparatus. When a paper is separated from the belt, irregular discharge occurs on the front of the paper. The document releases the irregular discharge to a collecting box or a transfer belt via a discharge brush directly contacting the rear of the paper. All the schemes described above are not the countermeasure against the dust due to color stacking, but they are merely for reference.

(i) Japanese Patent Laid-Open Publication No. 4-319979: An image forming apparatus using an intermediate transfer body is proposed, but it pertains to an image inverting function. Specifically, the intermediate transfer body is covered with toner beforehand, and the toner is collected by a photoconductive element except for necessary portions so as to produce an inverted copy. A reverse electric field is applied when the toner is actually returned to the photoconductive element. In a primary transfer section, the same bias is applied at the inlet and outlet. This is not the countermeasure against the dust, but it is also merely for reference.

(j) Japanese Patent Laid-Open Publication No. 5-265335: An image forming apparatus using an intermediate transfer body is disclosed. The apparatus has a main roller for primary transfer and determining the potential at a nip, an inlet roller, and an outlet roller. The biases to the inlet and outlet rollers are controlled, or the rollers are each connected to ground via a predetermined resistance and each holds a potential. This document is different from the present invention in object and construction.

None of the conventional approaches described above can satisfactorily prevent the transfer dust from appearing during primary transfer. Particularly, when the charge of toner of one color transferred to the intermediate transfer body remains at the time of the transfer of toner of the next color, the transfer dust is aggravated.

Figure 10:
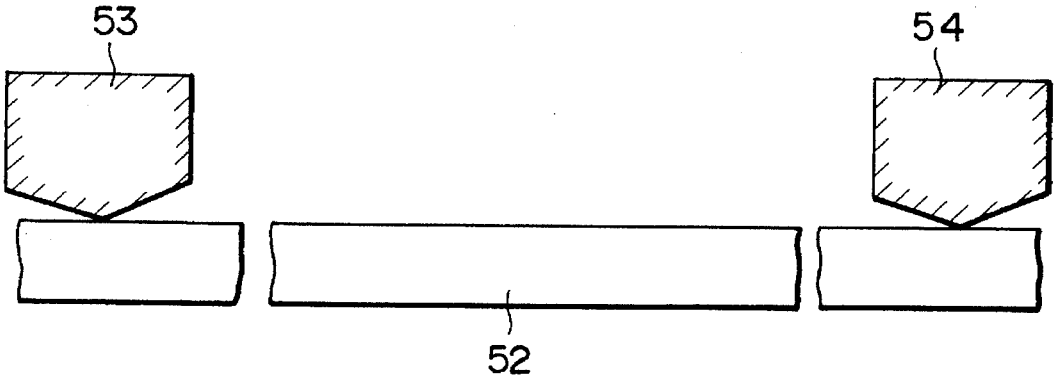
FIGS. 10 and 11 each shows another specific configuration of conductors included in the embodiment.
Figure 11:
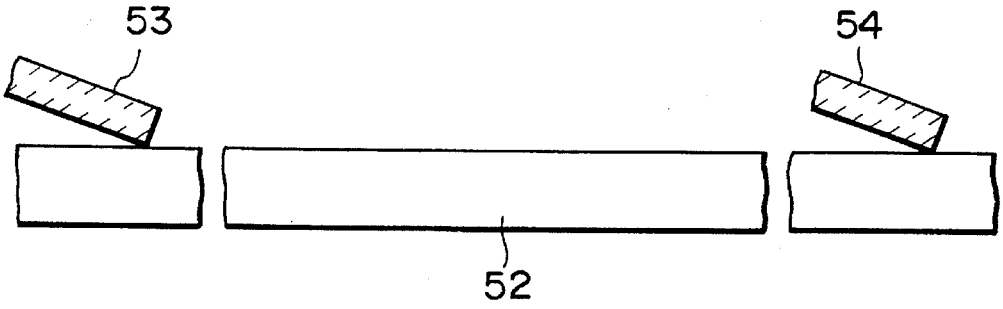

Preferred embodiments of the image transfer method in accordance with the present invention will be described with reference to the accompanying drawings. In the drawings, the same or similar constituent parts as or to the parts of the conventional arrangement are designated by the same reference numerals. While the conductors 53 and 54 have been shown and described as being implemented by rollers, they may be implemented as wedge-shaped conductors each having an obtuse angle, as shown in FIG. 10, or blade-like conductors, as shown in FIG. 11.

1st Embodiment

Figure 6A:
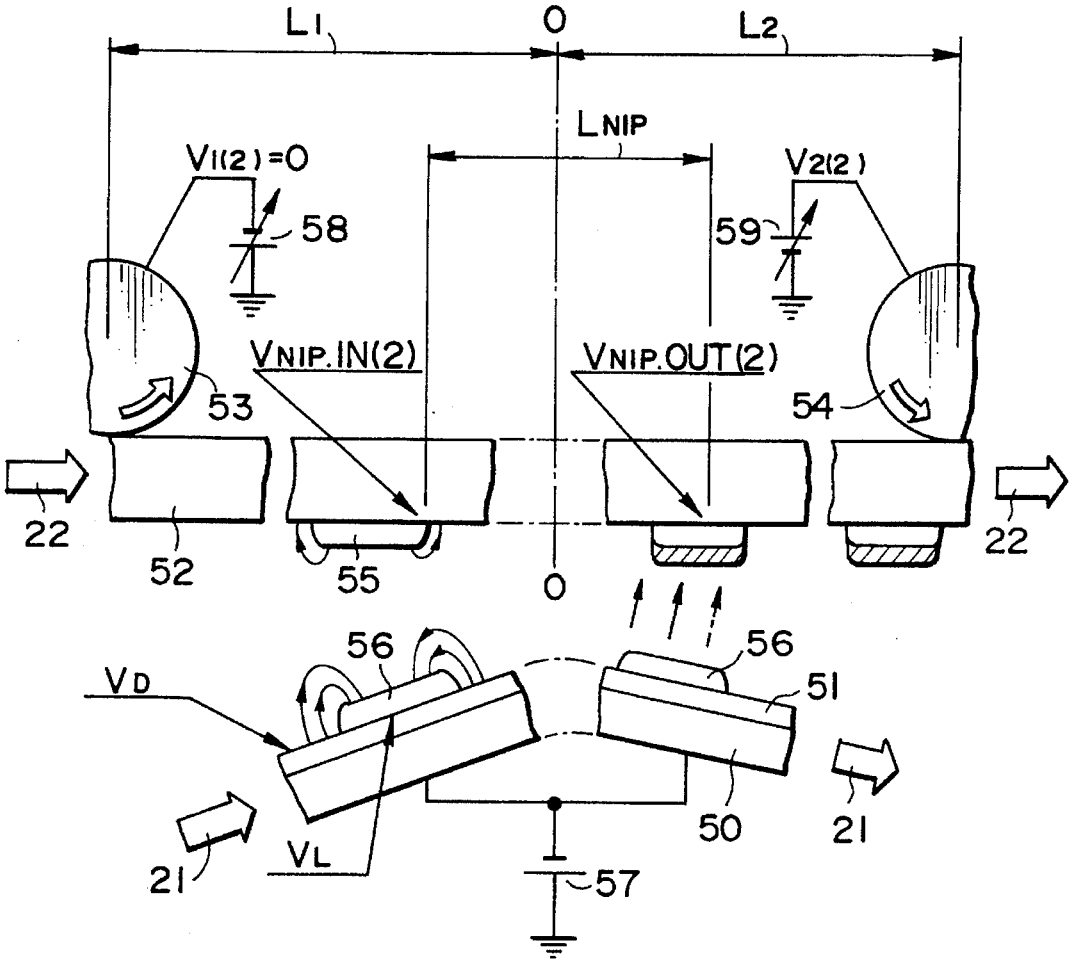
FIGS. 6A, 7A and 8A show a primary transfer section included in an embodiment of the present invention.

As shown in FIG. 6A, a first embodiment differs from the conventional arrangement in that an inlet conductor 53 is connected to the negative polarity of a variable voltage source 58. This polarity is the same as the polarity of a charged powder layer 56 carried on an image carrier or donor 51. An outlet conductor 54 is connected to the positive polarity of a variable voltage source 59, as in the conventional arrangement. The voltage sources 58 and 59 are respectively sequentially controlled such that a relation of $V_{1(1)}<V_{1(2)}<V_{1(3)}<V_{1(4)}$ and a relation of $V_{2(1)}<V_{2(2)}<V_{2(3)}<V_{2(4)}$ hold.

For the first primary transfer, potentials $V_{1(1)}$ and $V_{2(1)}$ are respectively selected to be zero and a suitable positive value, as in FIGS. 2A and 2B. For the second primary transfer and onward, the potential $V_{1(m)}$ is sequentially shifted toward the polarity (negative) of the layer 56 every time the primary transfer is repeated. FIGS. 6A and 6B, FIGS. 7A and 7B and FIGS. 8A and 8B demonstrate the second primary transfer, third primary transfer, and fourth primary transfer primary respectively. As a result, the electric line of force of the powder on the donor 51 changes little in direction. This allows a minimum of transfer dust, i.e., the lateral displacement of the powder due to a sharp change in the direction of the electric line of force to occur before actual transfer. Further, as to the transfer dust during transfer, the potential $V_{NIP,IN(2)}$ and the potential $V_L$ of the image portion of the donor 51 electrically approach each other, so that the electric line of force influencing the transfer at the inlet weakens. As a result, the transfer of the charged powder itself and, therefore, transfer dust decreases.

The above arrangement is not satisfactory alone, because it would lower the overall transfer ratio. To eliminate this problem, a potential more intense to the negative side is applied to part of the nip portion close to the outlet. In this condition, the dust is reduced at the inlet while an intense electric field is formed at the outside, so that the overall transfer ratio is prevented from decreasing.

The advantages of this embodiment are achievable not only with a full-color printer but also with any other image forming apparatus of the type stacking powder layers by repeating the intermediate or primary transfer based on the previously stated contact electric field forming system.

In the illustrative embodiment, the donor 51 is made of a semiconductor or an insulator and movable while carrying a charged powder thereon. An acceptor 52 adjoins the donor 51 and is made of a semiconductor or an insulator. The charged powder is transferred from the donor 51 to the acceptor 51 a plurality of times. Two conductors 53 and 54 are held in contact with the rear of the acceptor 52 and respectively located upstream and downstream, with respect to a direction of movement, of a position where the donor 51 and acceptor 52 adjoin each other. The conductors 53 and 54 are respectively spaced apart from the adjoining position of the donor 51 and acceptor 52 by distances $L_1$ and $L_2$. A potential $V_1$ of the same polarity as the charged powder on the donor 51 is applied to the conductor 53 while a potential $V_2$ opposite in polarity to the powder is applied to the conductor 54. The potential $V_1$ is sequentially shifted toward the polarity of the powder as the primary transfer is repeated. At the same time, the potential $V_2$ is sequentially shifted to the side opposite to the polarity of the powder. This successfully reduces powder dust or transfer dust.

2nd Embodiment

Figure 6B:
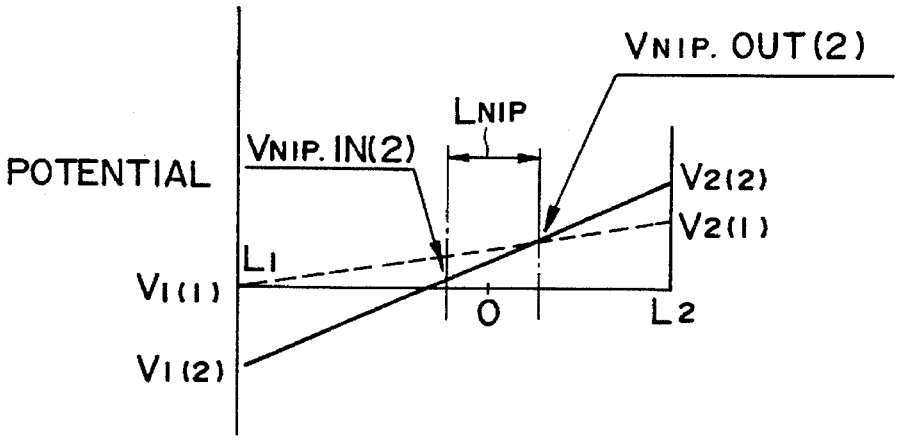
FIGS. 6B, 7B and 8B are respectively associated with FIGS. 6A, 7A and 8A, and each shows particular transfer biases.
Figure 7A:
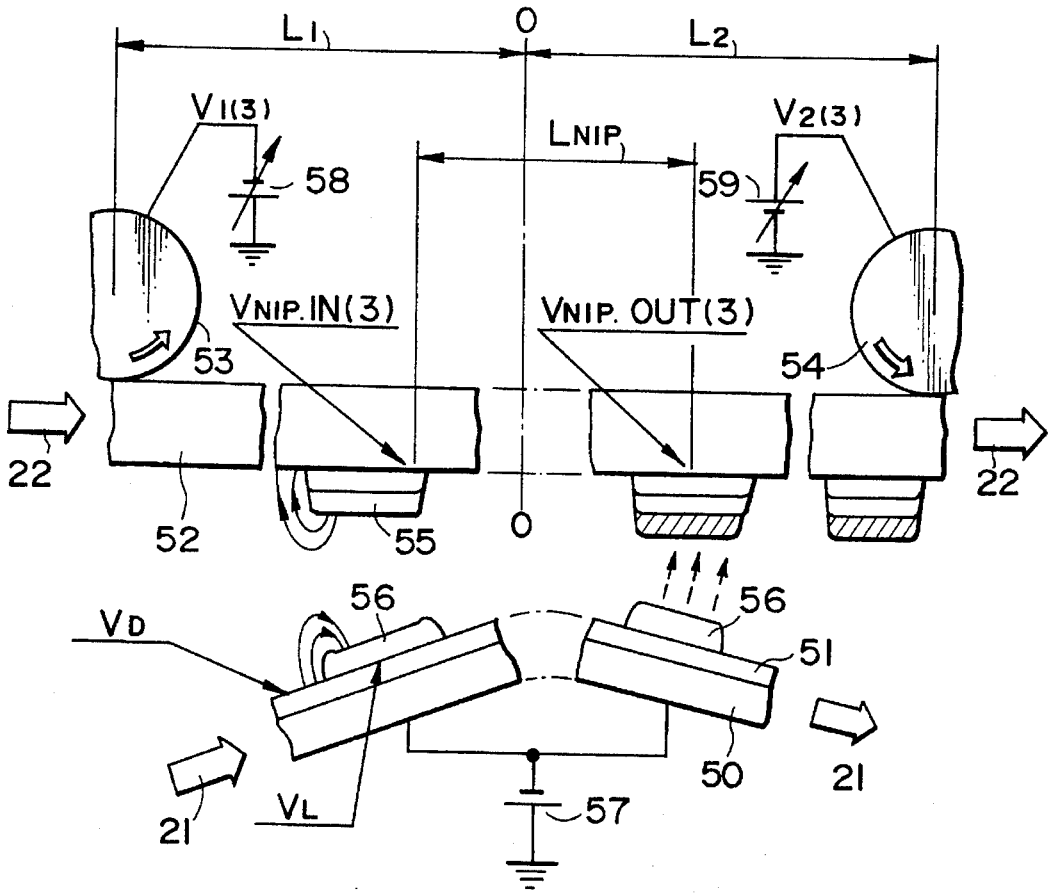
Figure 7B:
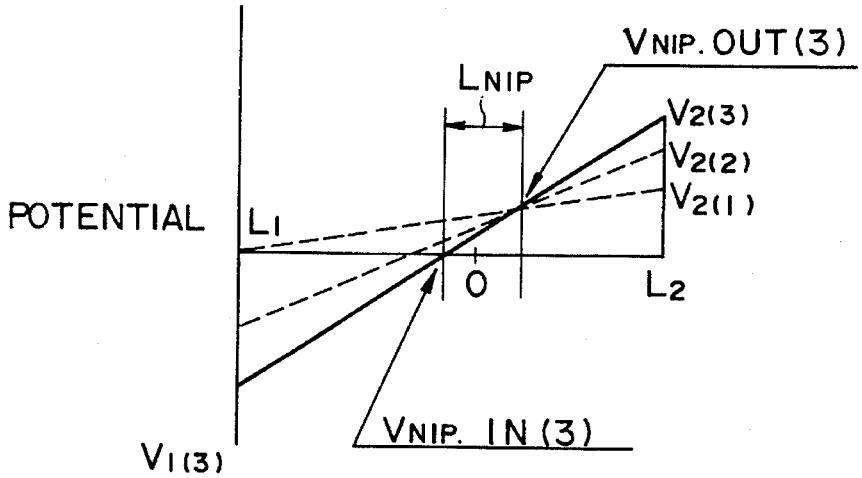
Figure 8A:
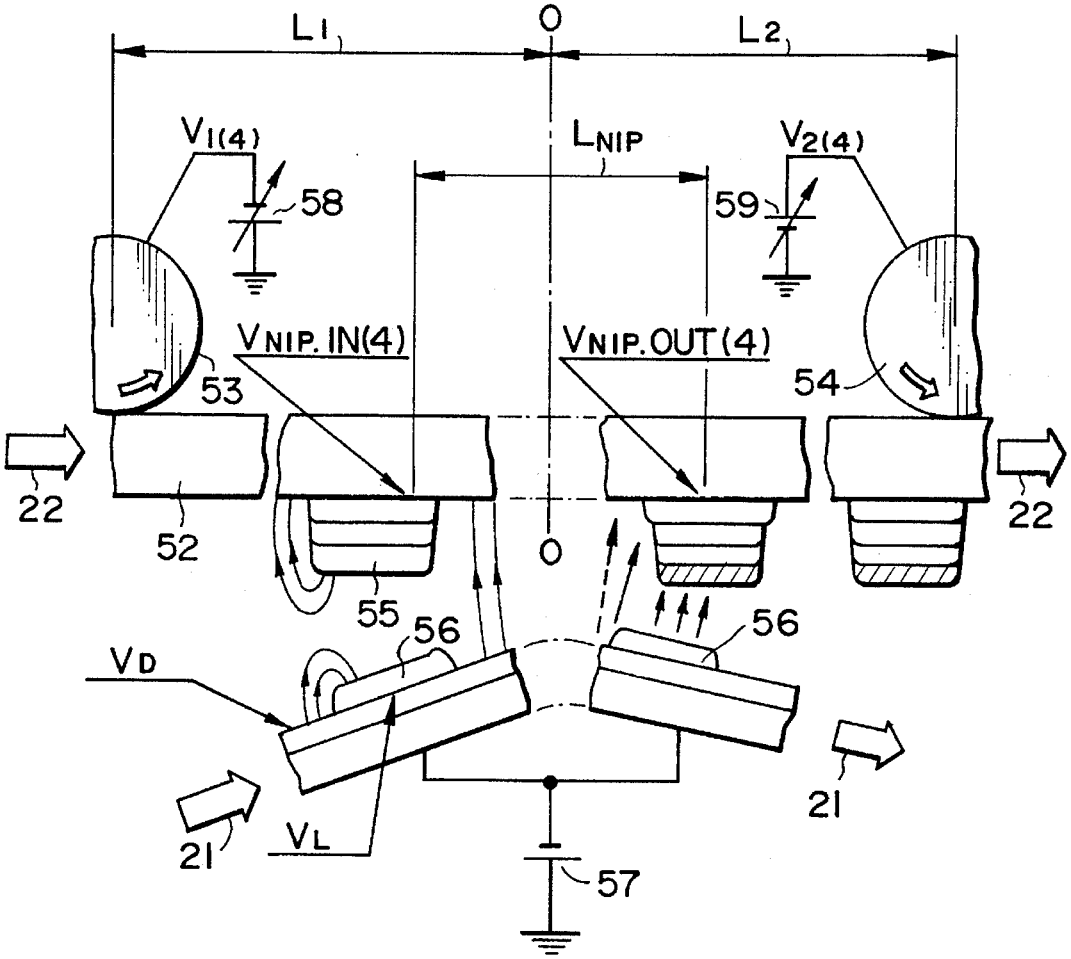
Figure 8B:
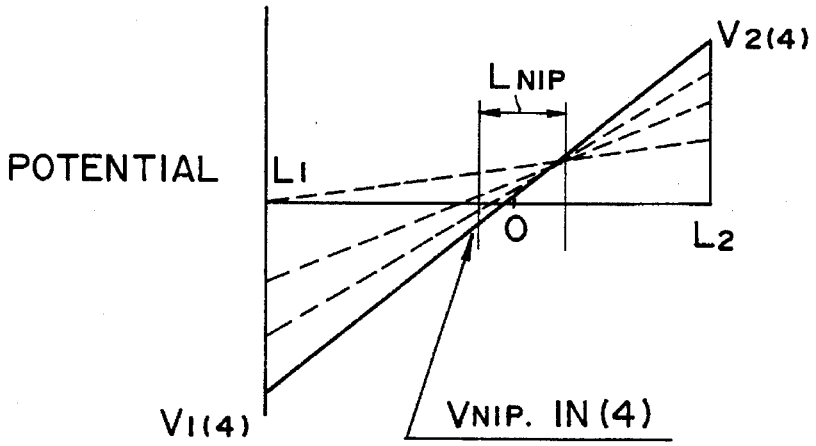

In the arrangement shown in FIGS. 6A and 6B, this embodiment provides the acceptor 52 with a mean volume resistivity of $10^8$ Ωcm to $10^{12}$ Ωcm in the thicknesswise direction. Specifically, in FIGS. 6A and 6B, the potential of the acceptor 52 in the nip portion is shown such that simple resistance division occurs due to the distance between the conductors 53 and 54. In practice, however, when the conductors 53 and 54 contacting the acceptor 51 are made of metal, the contact cannot be ensured due to the surface roughness and recesses of the acceptor 52. In air, dielectric breakdown occurs even in a small gap and allows the potential difference to be reduced. However, the dielectric breakdown of air generally proceeds in a manner which is noticeably dependent on the volume resistivity of a charge holding member. In this case, it is necessary that either one of the charge holding member and the acceptor has a mean volume resistivity of $10^8$ Ωcm to $10^{12}$ Ωcm. This range of resistivity prevents the dielectric breakdown from abruptly proceeding and, therefore, allows the discharge to be continued. When the discharge is constantly effected, the charge is constantly transferred from the rear of the acceptor to the conductors and from the latter to the former. As a result, the potential gradient shown in FIG. 6B occurs constantly and ensures desirable primary transfer.

If the volume resistivity of the acceptor 52 is excessively high, the charge remains (charge-up) to render the potential distribution uneven. As a result, the potential becomes irregular on both the front and the rear of the acceptor 52, resulting in an unstable potential gradient in the nip portion. On the other hand, if the volume resistivity is excessively low, the dielectric breakdown cannot be confined in a limited portion, so that a portion where the discharge current is sharp appears. This also results in an irregular potential distribution which obstructs the primary transfer.

As stated above, the embodiment uses an acceptor having a volume resistivity of $10^8$ Ωcm to $10^{12}$ Ωcm. This, coupled with the arrangement described in relation to the first embodiment, effectively reduces the transfer dust during the repeated primary transfer.

3rd Embodiment

This embodiment controls the bias in such a manner as to obviate the transfer dust most effectively during the primary transfer. The closer the potential $V_{NIP.IN}$ to the potential $V_L$ of the donor 51 underlying the powder layer or the neighborhood thereof (e.g. potential of the non-image area or background), the more the transfer dust before actual transfer is reduced, as stated in relation to the first embodiment. This is to preserve the retaining force on the donor 51 at the inlet side. To apply this to the control, the following equations are necessary.

First, the potential $V_{NIP.IN}$ is defined in relation to the distances $L_1$ and $L_2$ and potentials $V_1$ and $V_2$. When the distances $L_1$ and $L_2$ are sufficiently high relative to the potential $V_{NIP.IN}$, the potential $V_{NIP}$ in the nip portion is produced by:

$$V_{NIP}=(V_1\cdot V_2+V_2\cdot L_1)/(L_1+L_2)$$

The potential gradient in the nip length $L_{NIP}$ gives the potential at the nip inlet approximately, as follows:

$$V_{NIP.IN}=-(V_2-V_1)/(L_1+L_2)\times(L_{NIP}/2)+V_{NIP}$$

Assume that the potential $V_{NIP.IN}$ and the surface potential $V_{TS}$ of the charged powder measured by, for example, an electrometer beforehand have the following relation:

$$V_{NIP.IN}\rightarrow V_{TS}+\text{tm} \quad (1)$$

where the symbol "→" means that the left value is brought closer to the right value. This is also true with the following equation.

Further, the surface potential $V_{TA}$ was measured in a condition of $V_1=V_2=0$ when the primary transfer was not under way (the potential could be measured only with the powder layer because the potential of the acceptor 52 was zero). The control is effected as follows:

$$V_{TA}+V_{NIP.IN}\rightarrow V_L \quad (2)$$

The potential $V_{TA}$ must be repeatedly measured because the powder layer becomes thicker every time the primary transfer is repeated.

The above control (1) reduces the transfer dust before the actual transfer while the control (2) reduces it during the transfer. As for a full-color printer, the control (2) should preferably be effected in accordance with the number of times of primary transfer. While the potentials $V_1$ and $V_2$ are determined unconditionally, the potential $V_2$ cannot be reduced because it usually contributes a great deal to the transfer ratio. It is, therefore, preferable to determine the potential $V_2$ by experiments and then determined the potential $V_1$.

The foregoing description has concentrated on the first primary transfer. Usually, when the powder layer on the acceptor 52 is doubled in thickness, the surface potential of the layer is approximately doubled, i.e., the surface potential $V_{TA(2)}$ is approximately double the surface potential $V_{TA(1)}$. Hence, if the potentials $V_1$ and $V_2$ are so controlled as to bring the potential $V_{NIP.IN}$ closer to the potential $V_L$, the bias range for reducing the transfer dust can be effectively determined without resorting to experiments.

Figure 9A:
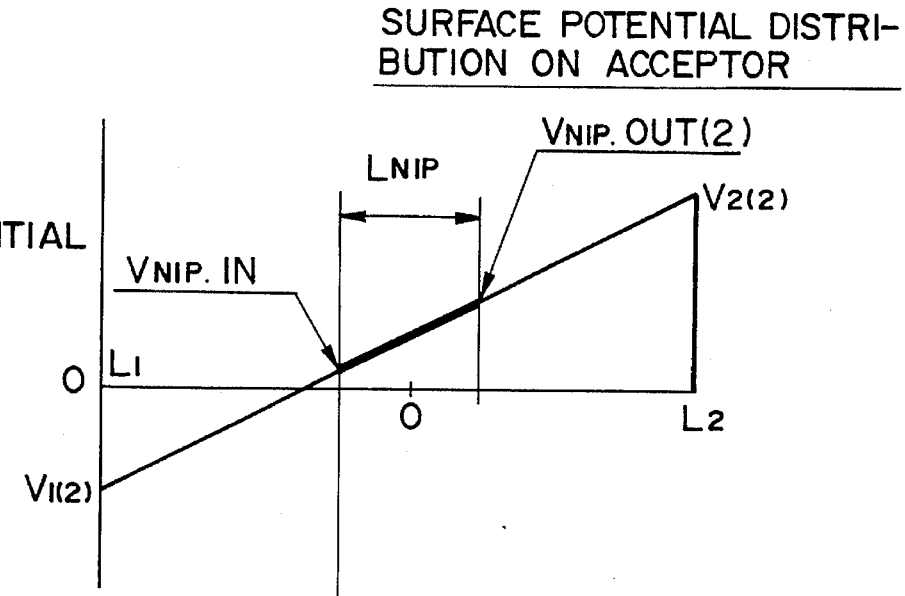
FIGS. 9A–9C show the potential distributions of an acceptor and powder.
Figure 9B:
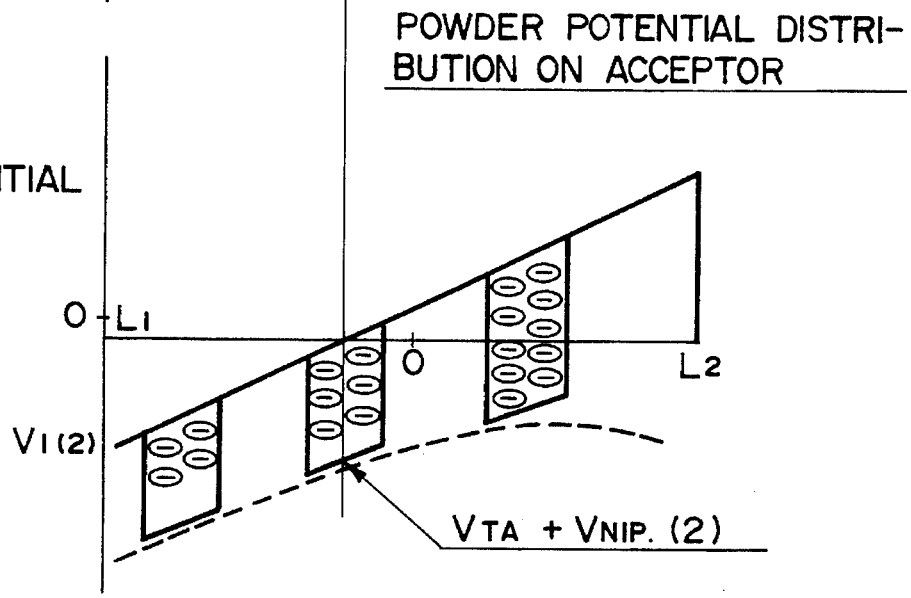
Figure 9C:
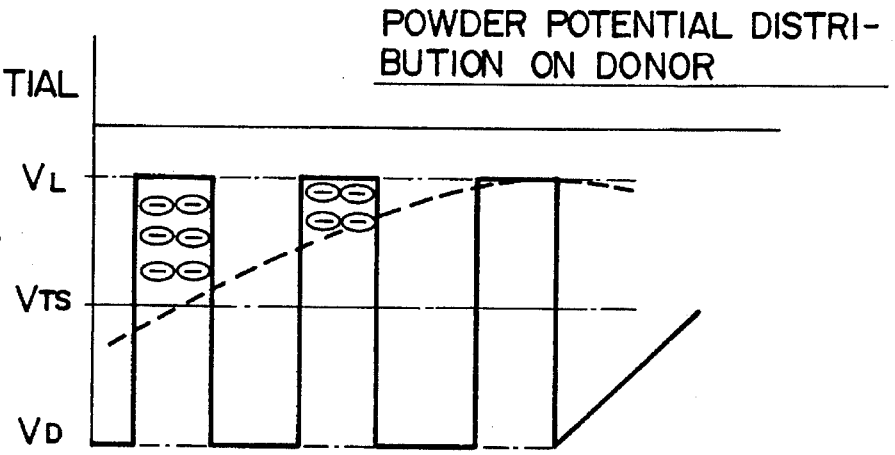

Assume that the potential distribution on the surface of the acceptor 52 is controlled as shown in FIG. 9A. Then, the powder potential is distributed on the acceptor 52 and the donor 51 as shown in FIGS. 9B and 9C, respectively. As a result, the transfer of the powder begins at the inlet of the nip length $L_{NIP}$ and ends at the outlet of the same. In FIGS. 9B and 9C, phantom lines indicate the surface potentials of the powder; the minus sign with a circle is representative of the negatively charged powder.

As stated above, the embodiment controls the potentials $V_1$ and $V_2$ such that the potential $V_{NIP}$ in the nip portion sequentially approaches the surface potential $V_{TA}$ of the powder transferred to the acceptor 52 as the primary transfer is repeated. Hence, a bias range for reducing the transfer dust can be readily determined.

4th Embodiment

This embodiment relates to the timing for controlling the potentials $V_1$ and $V_2$ and will be described with reference to FIG. 12 which shows general hardware applicable for such control. As shown, a CPU (Central Processing Unit) 61 controls via an I/O (Input/Output) section 62 the variable voltage sources 58 and 59, a motor 63 for driving the revolver 2, and a bias power source 64 for the revolver 2. A sensor responsive to the surface potential of the powder layer is located in at a position X adjoining the acceptor 52 and upstream of the nip portion. The output of the sensor is input to the I/O section 62.

Figure 13:
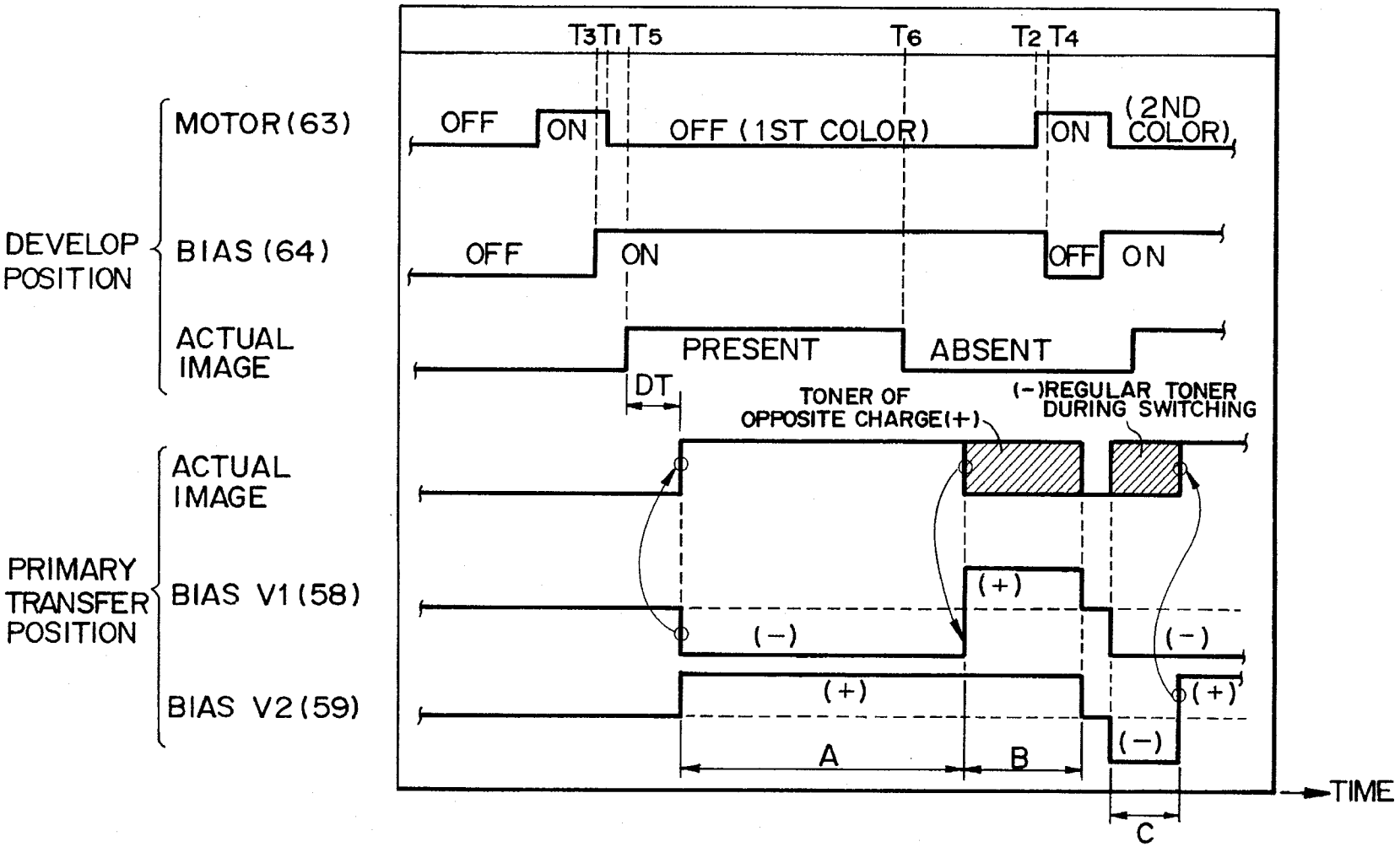
FIG. 13 is a timing chart demonstrating bias control available with the present invention.

FIG. 13 is a timing chart demonstrating the control of the hardware. There are shown in the figure a time $T_1$ when the revolver 2 ends rotating (one developing unit is brought to the developing position), a time $T_2$ when the revolver 2 starts rotating (the developing unit is moved away from the developing position), a time $T_3$ when the bias to the developing unit is turned on, a time $T_4$ when the bias is turned off, a time $T_5$ when the developing unit starts writing an image (the beginning of an image on a paper), a time $T_6$ when it ends writing the image (the end of the image on the paper), and a period of time $D_T$ necessary for the donor 51 move from the developing position to the primary transfer position, i.e., a time lag (=distance/speed).

In FIG. 13A, the primary transfer occurs in an interval A. In the interval A, the acceptor 52 has the potentials $V_1$ and $V_2$ respectively controlled to the negative polarity and the positive polarity, as in the first embodiment. In the actual machine, after the interval A, powder charged to the opposite polarity, i.e., negative polarity often remains on the donor 51. This kind of powder occurs due to the friction of the charged powder itself even if the developing unit is normal. Although the oppositely charged powder is small in amount, it should not be neglected in relation to the capacity of an acceptor cleaning unit because it continuously occurs even in the non-image area of the donor 51.

In the light of the above, during an interval B, the potentials $V_1$ and $V_2$ are controlled to the original polarity of the powder, i.e., positive polarity in order to retain the oppositely charged toner on the donor 51 or return it to the donor 51. The interval B begins when the image is absent, i.e., when the trailing edge of the powder on the acceptor 52 is about to reach the inlet of the nip portion and ends when the developing unit is replaced with another developing unit. The above control successfully reduces the capacity required of the acceptor cleaning unit and thereby miniaturizes it.

Figure 12:
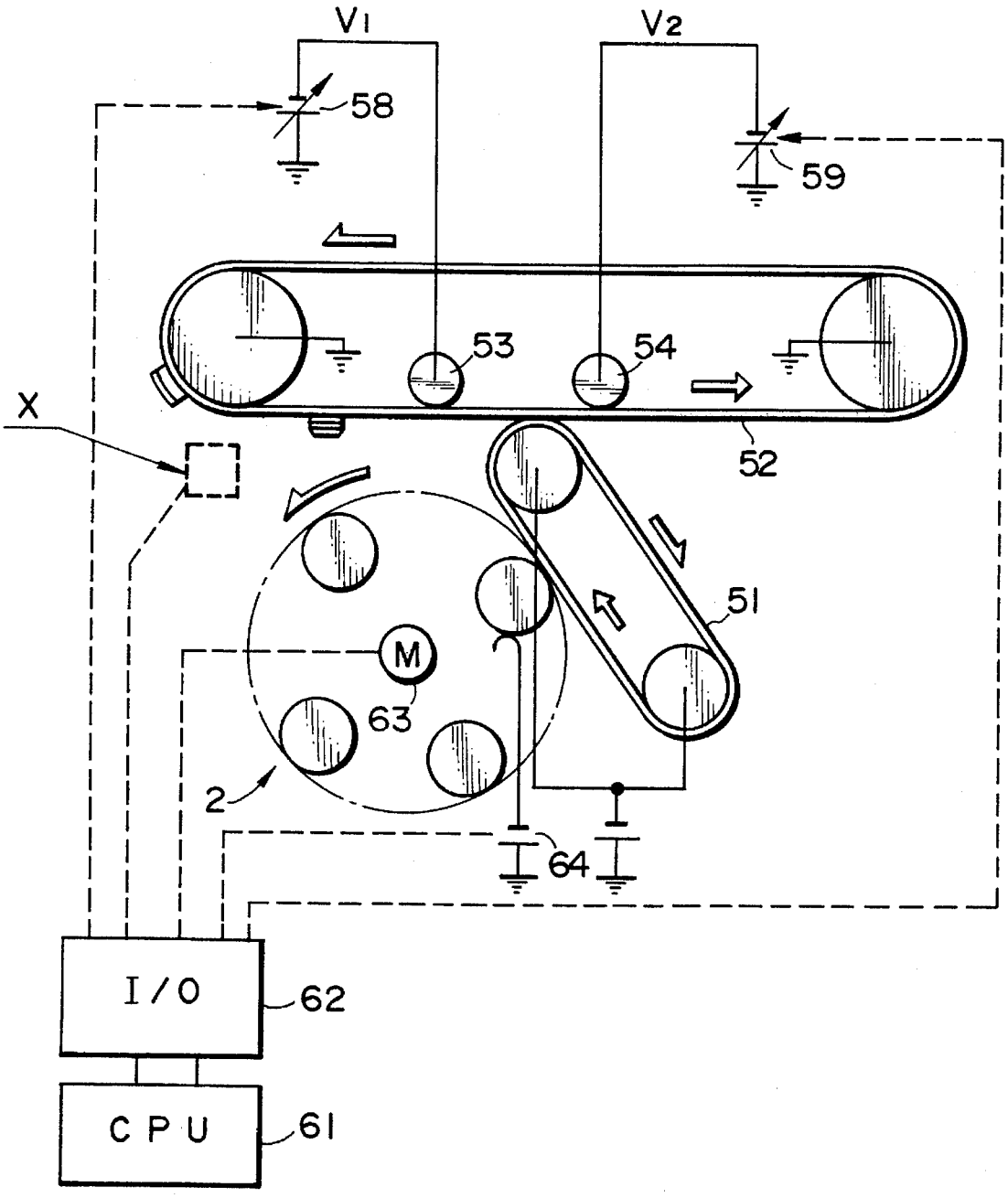
FIG. 12 is a section of an apparatus implemented by the method of the present invention.

As shown in FIG. 12, when the acceptor 52 is implemented as a belt rotatable in one direction, it must make one full turn after the transfer of one color even if the powder image is of small size and transferred to a paper of small size at the secondary transfer position. Then, during the interval A, the oppositely charged toner arrives at the primary transfer position despite that an image is absent. To prevent this toner form being transferred, the potentials $V_1$ and $V_2$ are controlled as shown in Table 1 below.

TABLE 1

Figure 15:
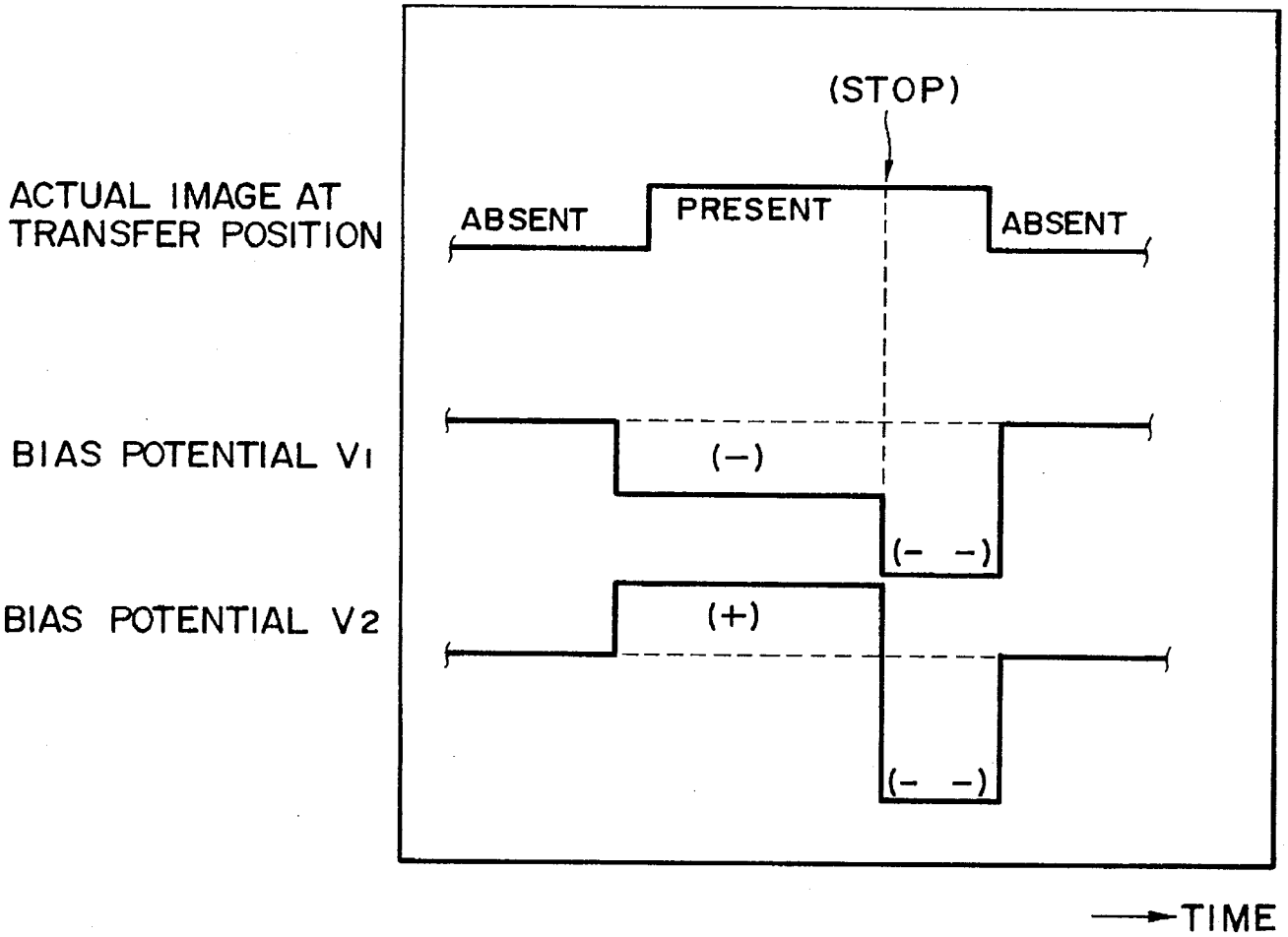
FIG. 15 is a timing chart demonstrating another bias control available with the present invention.

| Status | $V_1$ | $V_2$ | Interval |
|---|---|---|---|
| Image Formation | (−) | (+) | A (FIG. 13) |
| Non-Image Portion | (+) | (+) | B (FIG. 13) |
| Switching | (−) | (−) | C (FIG. 13) |
| Emergency Stop | (—) | (—) | FIG. 15 |

In Table 1, the symbol "—" indicates a negative bias higher than the usual negative bias.

Figure 14:
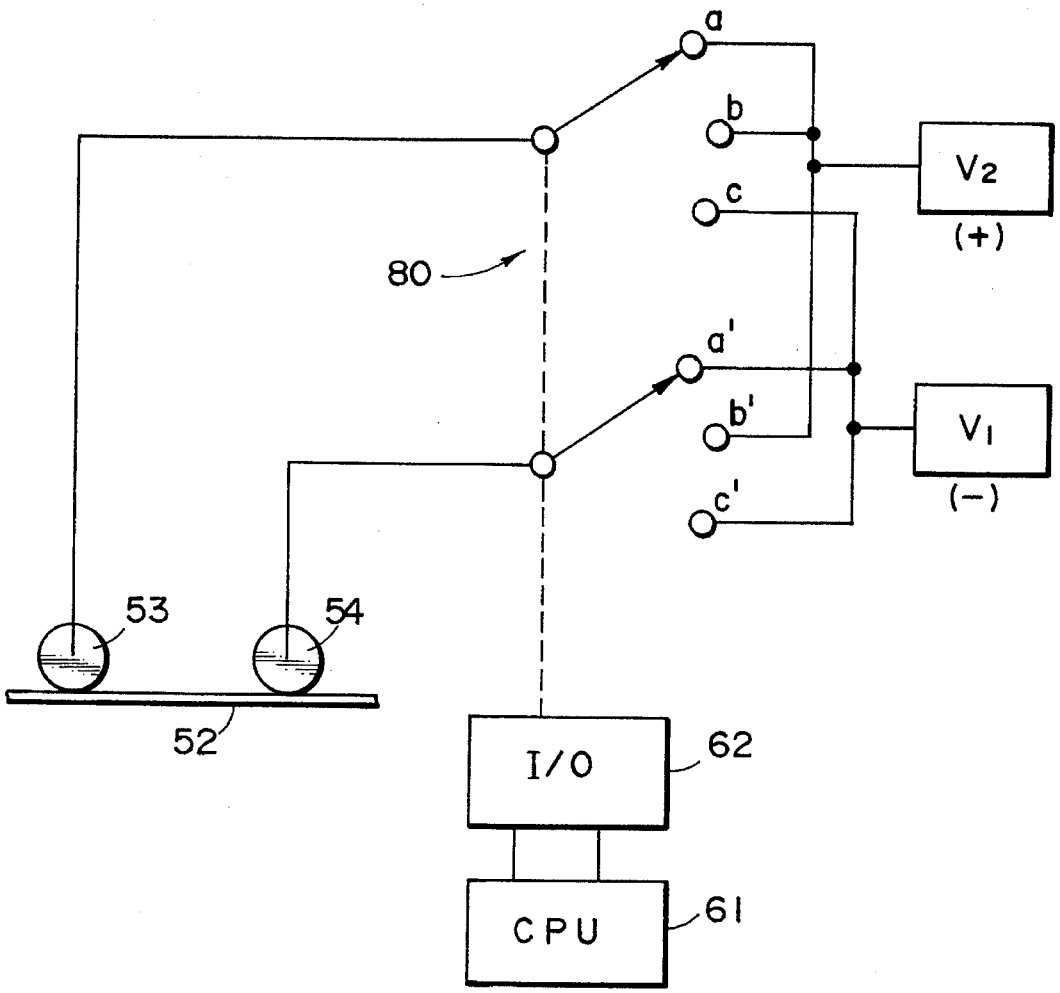
FIG. 14 shows an interlocked relation switch applicable to the present invention.

In this manner, the variable voltage sources 58 and 59 are controlled by the CPU 61 or similar controller. Alternatively, as shown in FIG. 14, use may be made of an interlocked relay switch 80 for the control. The relay switch 80 has terminals a, b and c extending from the $V_1$ voltage source, and terminals a', b' and c' extending from the $V_2$ voltage source. The terminals a and a', the terminals b and b' and the terminals c and c' are each selected in a pair. Voltages are preselected such that the previously stated adequate biases are selectively applied to the terminals a–c and a'–c'.

As stated above, when an image is not formed, the potentials $V_1$ and $V_2$ are controlled to the polarity opposite to the polarity of the charged powder. As a result, the capacity required of the acceptor cleaning unit can be reduced 5th Embodiment The first and second embodiments are applied to this embodiment. In a full-color mode, the revolver 2 is rotated to bring one of the developing units 6–9 to the developing position when the non-image area of the image carrier 51 is located at the developing position. When the image carrier 51 and the developing unit newly contact each other, a current circuit is formed therebetween and apt to cause the powder to deposit on the unexpected position of the carrier 51 due to the unnegligible electrostatic capacity of the carrier 51 and developing unit. In addition, the power is apt to deposit on the non-image area of the carrier 51 and disturb the image due to mechanical vibration.

The disturbance to the image is caused by the powder charged to the expected polarity, i.e., negative polarity in the embodiment. In FIG. 13, this powder is labeled "– (Regular) Powder during Switching" and occurs during the interval C. During the interval C, negative biases are applied to prevent such powder from being transferred from the donor 51 to the acceptor 52. Specifically, for a predetermined period of time beginning before the replacement of the developing unit, the bias potentials $V_1$ and $V_2$ are controlled to the same polarity as the powder (negative) so as to return the powder to the donor 51. This also successfully reduces the capacity required of the acceptor cleaning unit and thereby reduces its size. Again, use may be made of the interlocked relay switch 80 shown in FIG. 14.

6th Embodiment

In the apparatus shown in FIG. 1, assume that a stop command is generated while image formation using a laser beam is under way due to, for example, defective paper feed. Then, if the image on the donor 51 is transferred to the acceptor 52 and then collected by the acceptor cleaning unit, the load on the cleaning unit will increase. In this embodiment, even when an image is being formed on the donor 51, the polarity of the biases $V_1$ and $V_2$ is switched to the polarity of the powder (negative), as in the fifth embodiment, on the generation of a stop command. As a result, part of the powder of regular or negative polarity formed the image after the stop command is returned to and retained on the donor 51.

In the above condition, the potentials $V_1$ and $V_2$ are intensified more than in the transfer condition in order to enhance the returning efficiency. In FIG. 15, STOP is indicative of the time when the stop command is sent to the laser optics. At this time, part of the powder formed an image on the donor 51 before the generation of the stop command has already been transferred to the acceptor 52. Hence, this part of the powder cannot be dealt with. However, the other part of the powder formed the image after the generation of the stop command is not transferred to the acceptor 52 due to the intense negative biases $V_1$ and $V_2$.

As stated above, in the apparatus of the second embodiment, it is possible to reduce the capacity required of the acceptor cleaning unit by controlling the potentials $V_1$ and $V_2$ to the same polarity as the powder and values greater than conventional ones.

7th Embodiment

In the second and fifth embodiments, the surface potential $V_{TA}$ of the powder layer existing on the acceptor 52 is important in determining the various constants for bias control. However, the following factors usually change depending on the charged powder itself and developing condition:

Q/M: amount of charge per unit volume

M/A: mass of powder per unit area

Deposition: compensation of bulk density, and density

It follows that a change in the surface potential $V_{TA}$ should preferably be sensed every time the bias potentials $V_1$ and $V_2$ are applied in order to correct the potentials $V_1$ and $V_2$. For this purpose, the sensor is located at the position X shown in FIG. 12. The sensor senses the surface potential $V_{TA}$ of the powder layer being conveyed by the acceptor 52 toward the primary transfer position. While this powder may, of course, be implemented by the image, it will be more convenient to form a particular mark on one edge of the acceptor 52 each time. The output of the sensor is applied to the CPU 61 and used for the calculation of the second embodiment.

As stated above, by sensing the surface potential $V_{TA}$, it is possible to effect more delicate control for the prevention of the transfer dust.

8th Embodiment

At the time of the first primary transfer, because no toner exists on the acceptor 52, it sometimes occurs that the transfer dust does not appear in the manner shown in FIGS. 3A and 3B, but the transferred toner itself turns out the dust. Hence, to eliminate the transfer dust, it is preferable that the potentials $V_1$ and $V_2$ be controlled in such a manner as to bring the inlet potential $V_{NIP.IN}$ approaches the potential of the powder on the donor 51 beyond the potential $V_L$ from the beginning. In FIG. 6B, this can be done by further intensifying the potential $V_1$ to the negative side. This is also true with the primary transfer using a single color.

In summary, it will be seen that the present invention provides an image transfer method capable of obviating transfer dust in the event of the primary transfer.

Various modifications will become possible for those skilled in the art after receiving the teachings of the present disclosure without departing from the scope thereof. For example, the acceptor 52 may be provided with a double layer structure consisting of an inner semiconductor layer and an outer insulator layer. Even with this kind of acceptor, the present invention achieves the same advantages as with the acceptor having a single layer. It is to be noted that the semiconductor has an intermediate resistance of $10^8$ Ωcm to $10^{12}$ Ωcm, and the insulator has a resistance as high as $10^{13}$ Ωcm or above.

What is claimed is:

1. In an image forming apparatus comprising: an image carrier made of a semiconductor or an insulator;

an acceptor made of a semiconductor or an insulator, and adjoining or contacting one surface of said image carrier at a predetermined nip portion for image transfer, and movable in a same direction as said image carrier; and two conductors for applying biases for image transfer, and contacting the other surface of said image carrier, and respectively spaced apart from a middle point of said nip portion by distances L1 and L2 at an upstream side and a downstream side with respect to said direction;

a method of transferring charged powder being conveyed by said image carrier to said acceptor a plurality of times in a stack, said method comprising the steps of:

applying to one of said two conductors located at the upstream side a potential $V_1$ of a same polarity as the charged powder carried on said image carrier;

applying to the other of said two conductors located at the downstream side a potential $V_2$ opposite in polarity to the charged powder carried on sad image carrier; and sequentially increasing the absolute value of said potential $V_1$ having the polarity of the powder and the absolute value of said potential $V_2$ having the polarity opposite to the polarity of the powder every time an image transfer is repeated.

2. A method as claimed in claim 1, wherein said acceptor has a mean volume resistivity of $10^8$ Ωcm to $10^{12}$ Ωcm in a thicknesswise direction.

3. A method as claimed in claim 2, wherein assuming that part of said nip portion where said image carrier and said acceptor face each other at a distance smaller than a distance at which gaseous discharge begins to occur has a nip length $L_{NIP}$, that potentials deposited by said two conductors in said nip portion are nip potentials $V_{NIP}$, that the nip potential at an inlet of said nip portion is an inlet potential $V_{NIP.IN}$, that an equation of $V_{NIP.IN}=-(V_2-V_1)/(L_1+L_2)\times(L_{NIP}/2)+V_{NIP}$ (where $V_{NIP}=(V_1\cdot L_2+V_2\cdot L_1)/(L_1+L_2)$), and that the powder transferred to said acceptor has a surface potential $V_{TA}$, then said potentials $V_1$ and $V_2$ are controlled such that said nip potentials $V_{NIP}$ sequentially approach said surface potential $V_{TA}$ every time the image transfer is repeated.

4. A method as claimed in claim 1, wherein said apparatus further comprises a plurality of developing units each for depositing the charged powder on said image carrier, said plurality of developing units being sequentially brought to a predetermined developing position.

5. A method as claimed in claim 4, wherein said potentials $V_1$ and $V_2$ are controlled to the polarity opposite to the polarity of the charged powder on said image carrier from a time when a trailing edge of said charged powder on said acceptor is about to reach said inlet of said nip portion to a time when the developing unit at the developing position is replaced with another developing unit.

6. A method as claimed in claim 4, wherein said potentials $V_1$ and $V_2$ are provided with the same polarity as the charged powder on said image carrier for a predetermined period of time beginning before the developing unit at the developing position begins to be replaced with another developing unit.

7. A method as claimed in claim 6, wherein said surface potential $V_{TA}$ is sensed by a sensor.

8. A method as claimed in claim 1, wherein when image formation is stopped, said potentials $V_1$ and $V_2$ are controlled to the same polarity as the charged powder on said image carrier and made greater than potentials assigned to the usual image transfer.

9. A method as claimed in claim 1, wherein assuming that an image portion of said image carrier has a potential $V_L$, said potentials $V_1$ and $V_2$ are controlled such that said inlet potential $V_{NIP.IN}$ for a first image transfer approaches the polarity of the charged powder on said image carrier beyond said potential $V_L$.

* * * * *